United States Patent [19]

Vialars et al.

[11] Patent Number: 4,620,693

[45] Date of Patent: Nov. 4, 1986

[54] POLE LIFTING APPARATUS

[75] Inventors: Jacques Vialars; Alain Rossignol, both of Auch; André Vidal, Mirande; Lionel Sarrade, Auch, all of France

[73] Assignee: Electricite de France, Paris, France

[21] Appl. No.: 632,591

[22] Filed: Jul. 19, 1984

[30] Foreign Application Priority Data

Jul. 19, 1983 [FR] France ..... 83 11899

[51] Int. Cl.[4] ..... B66D 3/00

[52] U.S. Cl. ..... 254/335; 52/118; 52/120; 52/150; 254/387; 254/399

[58] Field of Search ..... 254/29 R, 30, 199, 213, 254/242, 335, 387, 398, 399, 413, 336, 337, 385; 52/111, 118, 120, 146, 150, 632; 173/81, 87

[56] References Cited

U.S. PATENT DOCUMENTS

| | | | |
|---|---|---|---|
| 873,799 | 12/1907 | Schafer | 254/29 R X |
| 2,779,569 | 1/1957 | Gills | 254/148 |
| 2,892,647 | 6/1959 | O'Neill | 287/58 |
| 3,231,260 | 1/1966 | Shirley | 254/336 X |
| 3,826,472 | 7/1974 | Woolslayer | 254/413 X |
| 3,991,978 | 11/1976 | Jones | 254/335 |
| 4,102,094 | 7/1978 | MacKinnon | 254/387 X |

FOREIGN PATENT DOCUMENTS

| | | | |
|---|---|---|---|
| 260520 | 7/1963 | Australia | 254/387 |
| 1066720 | 10/1959 | Fed. Rep. of Germany . | |
| 435549 | 3/1912 | France . | |
| 542859 | 8/1922 | France . | |
| 1223719 | 6/1960 | France | 254/29 R |

*Primary Examiner*—John M. Jillions

*Attorney, Agent, or Firm*—Charles E. Brown; Charles A. Brown

[57] ABSTRACT

Apparatus for lifting electric line poles is disclosed which also enables a ground rod or stake to be driven into the ground next to such a pole. There is provided a telescopic mast having a hoist with a rope run over pulleys to a lifting hook and attached at the upper end of the mast. For driving in ground rods or stakes a carriage mounted for movement along the mast is used which can be attached to the lifting hook and can secure an air hammer.

3 Claims, 11 Drawing Figures

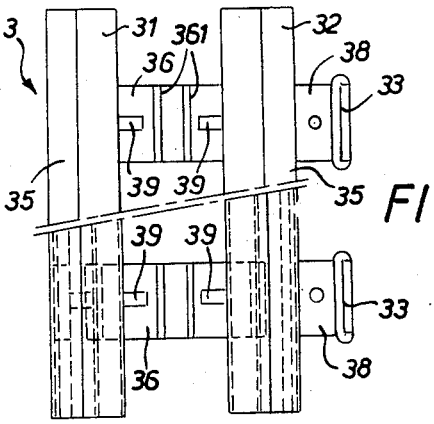
FIG.6
FIG.8
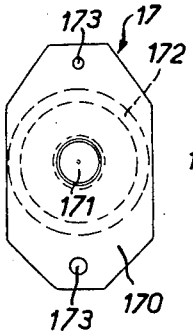
FIG.9
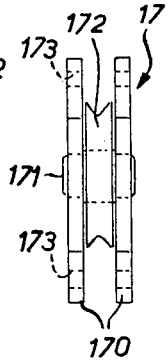
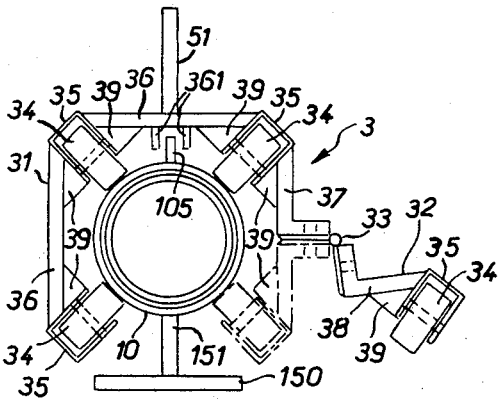
FIG.7

POLE LIFTING APPARATUS

FIELD OF THE INVENTION

The present invention relates generally to apparatus for lifting poles such as electric line poles or posts incorporating a hoist, the hoist having a rope running from the hoist through a lifting implement such as a hook and fixed to the upper end of the mast, and guys for steadying the mast also being fixed to the upper end of the mast.

BACKGROUND OF THE INVENTION

Known pole lifting apparatus comprise a solid wooden mast and are therefore relatively heavy and difficult to set up or ready for use. Further, they also require a separate apparatus for driving ground rods or stakes for line poles into the ground.

OBJECT AND SUMMARY OF THE INVENTION

An object of the invention is to overcome these drawbacks and provide a simple and economical pole lifting apparatus which is easy to set up and operate and requires a small mumber of workmen and which may quickly be installed even in locations which are not easily accessible.

According to the invention there is provided an apparatus for lifting a line pole or other post, comprising a telescopic mast including a base which bears on the ground and one mast section which is mounted for sliding movement inside another mast section between extended and retracted positions. A hoist is mounted on the other mast section and includes a rope which has a path extending from the hoist over direction change means at the upper end of the mast, through a lifting implement such as a hook, and back to the upper end of the mast where it is fixed. The lifting implement is adapted to raise a line pole, e.g., with a tie or lashing. A carriage is mounted for movement on the mast, means releasably connected to the carriage to the lifting implement for raising and lowering the carriage along the mast. The carriage has means for mounting an air hammer. The air hammer is used for driving in ground rods or stakes as required for at least some line poles.

Owing to the provision of a telescopic mast the latter may be easily transported for example by a van or small truck while enabling relatively long wooden poles to be lifted. Owing to the carriage having means for mounting an air hammer it is possible to quickly drive in ground rods or stakes for line poles without any separate apparatus.

According to another feature of the invention the telescopic mast is made of a lightweight metal such as aluminum or an aluminum alloy which permits the pole lifting apparatus according to the invention to be set up and operated by only two workmen.

These and other features and advantages of the invention will become apparent from the description which follows given by way of example with respect to a preferred embodiment illustrated in the accompanying drawings.

BRIEF DESCRIPTION OF THE DRAWINGS

FIG. 6 is a front view of a carriage of the pole lifting apparatus in its closed position;

FIG. 7 is a top plan view of the carriage shown in FIG. 6, illustrated in its open position in solid line and its closed position in dotted line;

FIG. 8 is a front view of a pulley for the lifting hook;

FIG. 9 is a side view of the pulley of FIG. 8;

DESCRIPTION OF THE PREFERRED EMBODIMENT

Figure 1:
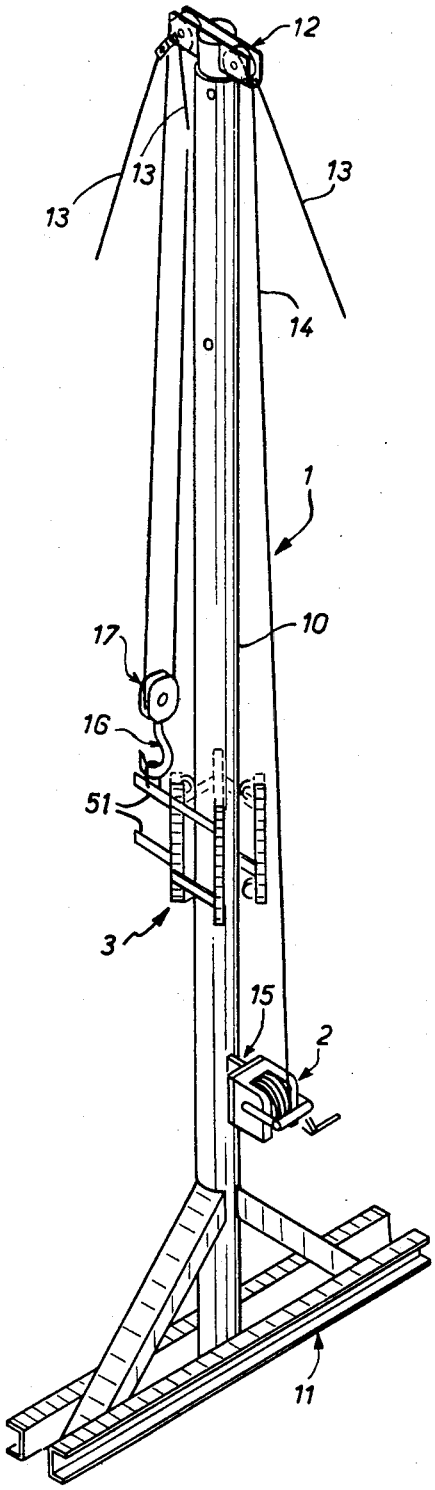
FIG. 1 is an overall view of the pole lifting apparatus according to the invention.

The pole lifting apparatus 1 according to the invention comprises (see FIG. 1) a mast 10 having a base 11 at its lower end which is adapted to bear against the ground and a bracket 12 at its upper end for suspending three guys 13 adapted to be anchored into the ground with stakes (not shown) and defining edges of a tetrahedron, and a lifting rope 14 is also attached at one end to the bracket 12. The function of the lifting rope will be described below. A hoist 2 is fixed to the mast 1 by fixing means 15 provided on the mast 10 proximate to the base 11. A movable carriage 3 is mounted for sliding movement along the mast 10. The carriage, in operation, is releasably secured to the lifting rope 14 by means of a lifting implement such as hook 16 attached to a pulley block 17.

Figure 2:
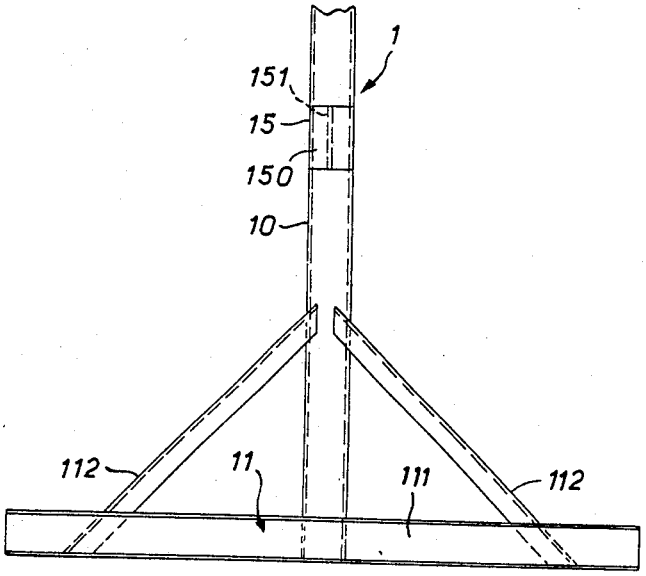
FIG. 2 is a detail view of the base of the mast of the pole lifting apparatus.

The base 11, best seen in FIGS. 1 and 2, comprises two U-shaped horizontal sections 111 which are adapted to bear against the ground and are arranged with their bight portions facing each other, with the mast 10 itself forming a spacer at their mid-sections and one of the ends of inclined struts or braces 112 interposed between the U-shaped sections 111 near the ends thereof, the other of the ends of the struts or braces 112 being fixed to the mast 10 some tens of centimeters from the bottom end of the mast.

Figure 3:
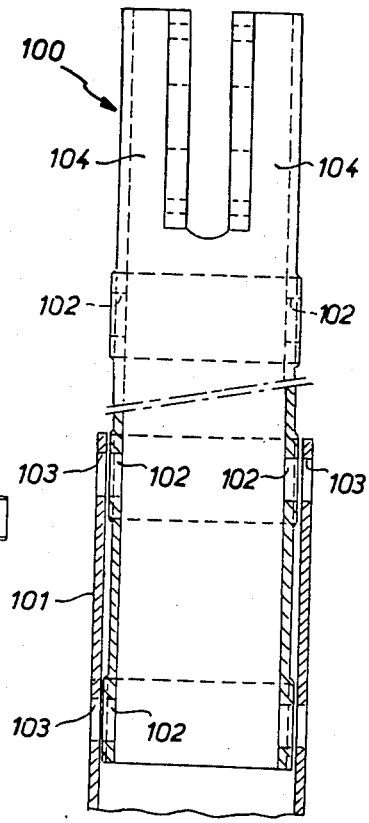
FIG. 3 is a detail sectional view illustrating the telescopic mast.

The telescopic mast 10, as best shown in the detail view of FIG. 3, comprises hollow cylindrical sections longitudinally slidably mounted inside each other, more particularly the upper section 100 being slidable inside the lower cylindrical section 101. The position of the telescopic mast 10 is fixed in its extended position by pins (not shown) inserted in transverse holes 102 and 103 in registry at suitable locations in the respective upper and lower sections 100, 101 of the mast 10. Other holes (not shown) in the lower cylinder section may be provided to come into register with holes 102, in the upper section in the retracted position of the telescopic mast.

Figure 4:
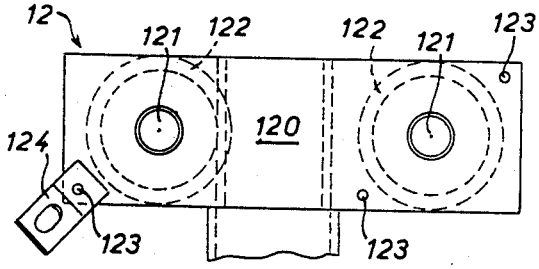
FIG. 4 is a front view of a bracket at the upper end of the mast.
Figure 5:
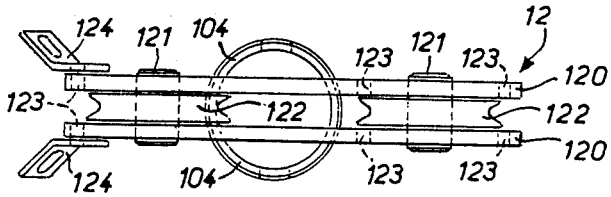
FIG. 5 is a top plan view of the upper end of the mast.

The top end of the mast 10 comprises a bifurcated portion between the arms 104 of which is received and fixed the bracket 12. The bracket 12, best seen in FIGS. 4 and 5, comprises two side plates 120 fixed together by studs or pivots 121 disposed to opposite sides of the bifurcated end portion of the mast 10. The studs 121 freely mount respective idle pulleys 122 which are interposed between side plates 120. Side plates 120 have holes 123 for fixing lugs 124 having suitably shaped oval apertures for securing the guys 13 and the end of lifting rope 14.

The means 15 for fixing the hoist 2 comprises a mounting plate 150 extending parallel to the axis of the mast 10 and fixed thereto by a vertical rib 151 extending radially with respect to the cross section of the lower section 101 of the mast 10 (see FIGS. 2 and 7). The hoist 2 which has a hand crank and may be of any known construction is fixed to the mounting plate 150 by screws or bolts cooperable with complementary holes in the mounting plate 150.

The carriage 3 (see FIGS. 6 and 7) surrounds the mast 10 when closed and permits good rolling movement therealong. The carriage 3 comprises pintles 33 parallel to the axis of the mast 10 for pivotally mounting first and second parts 31, 32 of the carriage 3.

On operation the carriage 3 is in a closed position surrounding the mast (FIG. 6), and the carriage is open for mounting or dismounting the same as shown in solid lines in FIG. 7, the open position being illustrated in dotted lines in the same figure.

The carriage 3 comprises two sets of four rollers 34 adapted to roll along the outer surface of the mast 10. The two sets of rollers 34 are of identical configuration and arranged in pairs of longitudinally aligned rollers 34. The rollers 34 of each set are arranged at 90° to each other around the axis of mast 10. Both rollers of a pair of rollers 34 are accommodated between two legs of a single yoke 35 extending longitudinally several tens of centimeters. Three of the yokes 35 are carried by the first carriage part 31, and the fourth yoke by the second carriage part 32, the three yokes 35 associated with the first part 31 are connected by transverse bars 36. An L-shaped bar 37 is connected to one of the endmost yokes 35 and includes a leg projecting away from the axis of the mast 10. The hinges 33 are provided at the free end of the projecting leg of the L-shaped bars 37. The single yoke 35 carried by the second part 32 of the carriage 32 is mounted by two L-shaped bars 38 identical to L-shaped bars 37. To rigidify the carriage 3 each connecting zone between an arm of one of the yoke 35 and a bar 36, 37 or 38 is provided with a gusset 39 of triangular shape when viewed parallel to the axis of the mast.

For longitudinally guiding the carriage along the mast 10, the latter is equipped with a radially and longitudinally extending external rib 105 (see FIG. 7) which cooperates with a slideway provided on the inside of the carriage 3 in which the rib is received. The slideway is formed by the space between two ribs 361 projecting inwardly of and perpendicularly to a corresponding connecting bar 36 of the upper and lower parts of the carriage and extending longitudinally along the mast 10.

The radially outwardly projecting legs (when viewed in the closed position) of each of the L-shaped bars 38 for the upper and lower parts of the carriage 3 have holes for a retaining pin for holding the carriage closed and upper and lower struts 51 for securing an air hammer, as will be described below.

Figure 10:
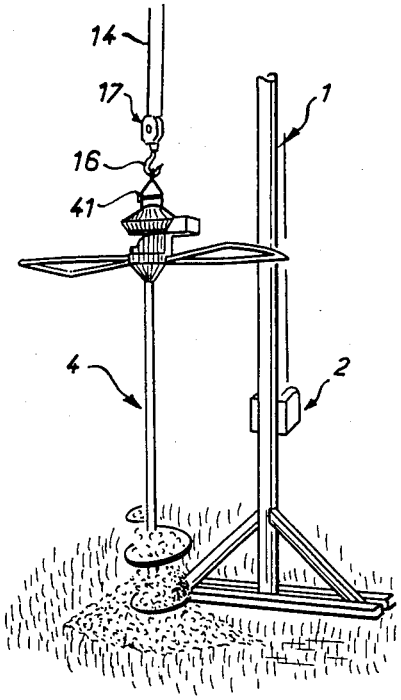
FIG. 10 illustrates the use of the pole lifting apparatus with a manual earth auger.
Figure 11:
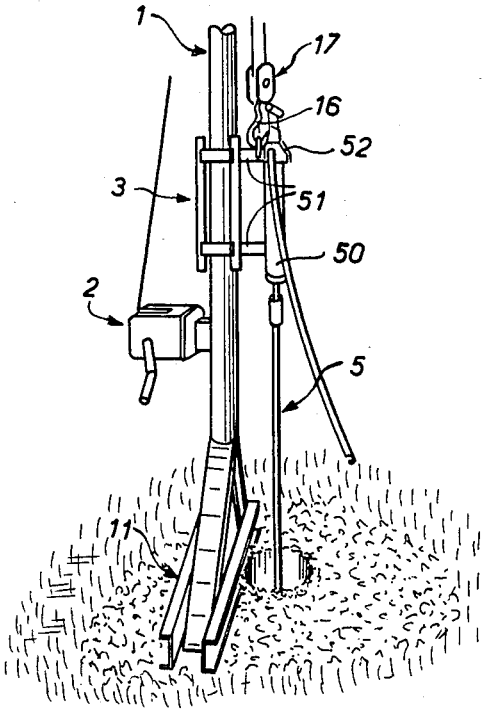
FIG. 11 illustrates the operation of the pole lifting apparatus with air hammer for driving in a ground rod or stake for a line pole.

The pulley block 17 comprises, as shown in FIGS. 8 and 9, two side plates 170 parallel to each other and connected together by a pivot 171 for an idle pulley wheel 172. The side plates 170 have holes 173 for fixing a lifting hook 16 (FIGS. 10 and 11).

Each of two guys 13 is anchored in an oval hole in a lug 124 on the bracket 12 and the third guy 13 is anchored in a pair of holes 123 in registry in the opposed side plates 120.

One end of the lifting rope 14 is anchored in two other holes 123, in registry, in the opposed side plates 120 of the bracket 12 and the other end of the lifting rope 14 is attached to the hoist 2 around which it is to be wound. The path of the rope 14 runs from the hoist 2 to the bracket 12 over the pulleys 122, around the lifting pulley block 17 and on to the anchoring holes 123 in the bracket 12 where it is secured.

For lifting a line pole it is unnecessary to utilize the carriage 3 or mount the carriage on the mast 10. This also applies to the boring of a hole in the ground by means of a manual earth auger (see FIG. 10). On the other hand the carriage 3 is required for driving in a ground rod or stake for grounding the line pole.

Practically speaking, the embodiment disclosed constitutes an apparatus for lifting wooden line poles 12 meters long (not shown). To this end, in the extended position the mast is 6.5 meters long, the upper section of the mast is about 4.5 meters long. In the retracted position the height of the mast is about 4.5 meters. The mast 10 is preferably made of aluminum or an aluminum alloy so that it is light in weight whereby it can be operated with only two workmen.

Owing to the compact size of the apparatus when the mast 10 is in its retracted position it may be transported with the carriage removed easily on a van or truck.

The mast is set up, in its extended position, at a site, one workman pulls on one of the guys and the other gradually lifts the mast 10 from its upper end towards its base 11 until the apparatus reaches a vertical position.

To bore a hole in the ground with a manual earth auger 4 (FIG. 10) a ring 41 on the earth auger 4 is hooked on lifting hook 16. Two workmen can operate such an earth auger. The earth auger 4 is lowered to the desired position by operating the hoist 2. The operation of such an earth auger is well known to those skilled in the art and need not be described in greater detail herein.

For lifting a line pole, upper end of the line pole is brought into the vicinity of the base of the pole lifting apparatus, the hook is attached to the line pole by a suitable tie or lashing and then one of the workmen operates the hoist to lift the upper end of the line pole while the other workman guides the lower end of the line pole into a hole previously bored in the ground at the desired location.

To drive an earth rod or stake into the ground the carriage 3 must be employed. To this end the open carriage is received on the mast 10 and the three rollers 34 of the first part 31 are brought into contact with the mast 10. Then the second part 32 of the carriage 3 is swung to its closed position from the solid line position to the dotted line position of FIG. 7, whereupon the rollers on the second part of the carriage, are also in rolling contact with the mast 10. While one of the workmen holds the carriage 3 the other locks the carriage closed with a pin or the like and fixes an air hammer 50 thereto as shown in FIG. 11, by means of two transverse struts 51. A ring is provided on the upper strut 51 to releasably connect the carriage to the hook 3. A counterweight is defined by the weight at the struts. Thereupon the operation of the hoist 2 moves the carriage 3 along the mast 10. In this operating mode the lower section 101 of the mast 10 is constructed and arranged to lift the carriage 3 to a height of about 3.5 m.

A rodlike adaptor 5 is expediently fitted on the actual air hammer 50 and cooperates with the outermost rod element. This permits a given element of the earth rod or stake to be driven to the level of the ground, that is, below the lowest position of the carriage 3 along the mast 3.

Such a ground rod or stake 5 is well known to those skilled in the art and need not be described in great or detail here. Suffice it to say that the total length of such a ground rod or stake for a line pole is generally between 10 and 20 meters long and comprises a plurality of identical elements one or two meters long. They are driven into the ground one on top of another, and one after another, by action of the air hammer 50 which is raised and lowered for this purpose. The top end of the ground rod or stake is connected by a suitable connector to an insulated conductor which is run up the side of the associated pole line.

As is known it is usually unnecessary to ground each line pole. Accordingly the carriage need only be used for driving in a ground rod or stake for some line poles. Conversely the present line lifting apparatus may be used for driving in a ground rod or stake adjacent to a preexisting line pole or other line support.

The present invention is not intended to be limited to the illustrated embodiment but on the contrary admits of various alternatives and modifications understood to those skilled in the art without departing from the spirit and scope of the present invention.

What we claim is:

1. Apparatus for lifting a line pole or other post, said apparatus comprising a telescopic mast including a base for bearing on the ground, and one mast section mounted for sliding movement inside another mast section between extended and retracted positions, a hoist, means for mounting said hoist on said other mast section, one end of a rope being fixed to said hoist, said rope having a path extending from said hoist over direction change means at the upper end of said mast, through a lifting implement, and back to the upper end of said mast where the other end of said rope is anchored, said lifting implement being adapted to raise a line pole, a carriage removably mounted on said mast, means for releasably connecting said carriage to said lifting implement, said carriage including guide means for raising and lowering movement along said mast, said carriage having means for mounting a power tool for driving in a ground rod or stake, said removable carriage comprising first and second parts pivotally connected together and surrounding said mast and wherein said removable carriage comprises means for releasably securing said first and second parts of said removable carriage together.

2. Apparatus according to claim 1, wherein said guide means comprises rollers adapted for rolling along the outside of said mast.

3. Apparatus for lifting a line pole or other post, said apparatus comprising a telescopic mast including a base for bearing on the ground, and one mast section mounted for sliding movement inside another mast section between extended and retracted positions, a hoist, means for mounting said hoist on said other mast section one end of a rope being fixed to said hoist, said rope having a path extending from said hoist over direction change means at the upper end of said mast, through a lifting implement, and back to the upper end of said mast where the other end of said rope is anchored, said lifting implement being adapted to raise a line pole, a carriage removably mounted on said mast, means for releasably connecting said carriage to said lifting implement, said carriage including guide means for raising and lowering movement along said mast, said carriage having means for mounting a power tool for driving in a ground rod or stake; said guide means comprising two parts surrounding said mast, said parts being movable relatively to each other, and means for releasably securing said parts together.

* * * * *